US009876312B1

(12) United States Patent
Li

(10) Patent No.: US 9,876,312 B1
(45) Date of Patent: Jan. 23, 2018

(54) DOUBLE LOCKING MECHANISM BETWEEN PLATE END AND CABLE END OF ETHERNET VEHICLE CONNECTOR

(71) Applicant: Amphenol East Asia Electronic Technology (Shen Zhen) Co., Ltd., Shenzhen (CN)

(72) Inventor: Zuxin Li, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 15/480,951

(22) Filed: Apr. 6, 2017

(51) Int. Cl.
*H01R 13/627* (2006.01)

(52) U.S. Cl.
CPC ..... *H01R 13/6275* (2013.01)

(58) Field of Classification Search
CPC ..... H01R 13/6275; H01R 13/6582; H01R 13/6271
USPC ..... 439/353, 345
See application file for complete search history.

(56) References Cited

U.S. PATENT DOCUMENTS 5,759,058 A * 6/1998 Childs ..... H01R 13/641 439/352
6,261,116 B1 * 7/2001 Ceru ..... H01R 13/6272 439/352
6,435,895 B1 * 8/2002 Fink ..... H01R 13/6272 439/352
6,439,915 B2 * 8/2002 Kurimoto ..... H01R 13/6272 439/352
6,716,052 B2 * 4/2004 Kane ..... H01R 13/641 439/352
6,780,045 B2 * 8/2004 Shuey ..... H01R 13/641 439/352
7,108,542 B2 * 9/2006 Ishiwa ..... H01R 13/641 439/352
7,393,233 B2 * 7/2008 Machida ..... H01R 13/6272 439/353
7,399,195 B2 * 7/2008 Kim ..... H01R 13/641 439/352
7,909,638 B2 * 3/2011 Seo ..... H01R 13/6272 439/352
8,920,187 B2 * 12/2014 Kon ..... H01R 13/6272 439/352
9,231,342 B2 * 1/2016 Kataoka ..... H01R 13/639
2015/0140853 A1 * 5/2015 Hashimoto ..... H01R 13/641 439/354

* cited by examiner

*Primary Examiner* — Tulsidas C Patel
*Assistant Examiner* — Travis Chambers
(74) *Attorney, Agent, or Firm* — Maier & Maier, PLLC

(57) ABSTRACT

A double locking mechanism between plate end and cable end of Ethernet vehicle connector. The double locking mechanism includes a plate end connector body, a cable end connector body and a locking plate, in which the connector bodies are pluggable with each other. The plate end connector body includes a fastening plate located at its top end, at the near pluggable end, the fastening plate is provided with an inward hook, which is provided with a sliding slope at the near pluggable end. The cable end connector body includes a fastening bar located at the top of itself, the fastening bar includes a long incline and a short incline respectively located at its near and distal pluggable ends. The locking plate includes a longitudinal resilient fastener and two transverse resilient fasteners respectively located in the middle and at the two sides of the locking plate.

2 Claims, 1 Drawing Sheet

DOUBLE LOCKING MECHANISM BETWEEN PLATE END AND CABLE END OF ETHERNET VEHICLE CONNECTOR

TECHNICAL FIELD

The present application relates to the field of fastening mechanism of connector, particularly to a double locking mechanism between plate end and cable end of Ethernet vehicle connector.

BACKGROUND

Ethernet vehicle connectors (comprising plate end and cable end) are mainly used for high speed network signal transmitting (velocity of which is usually about 1 Gbps) and connecting lighting circuits of vehicles. Nowadays, the self locking mechanisms of cable end connector are rather complicated and difficult to operate and maintain, and similar problems are also existed in locking mechanism between plate and cable ends.

SUMMARY OF THE APPLICATION

To solve the above described technical problems, the present application provides a double locking mechanism between plate end and cable end of Ethernet vehicle connectors which is constructively simple and easier to operate.

To achieve above described objective, the technical solutions to the application are detailed as follows: a double locking mechanism between plate end and cable end of Ethernet vehicle connectors comprises a plate end connector body, a cable end connector body and a locking plate, wherein the connector bodies are pluggable with each other.

The plate end connector body includes a fastening plate located at its top end, at the near pluggable end, the fastening plate is provided with an inward hook, which is provided with a sliding slope at the near pluggable end.

The cable end connector body includes a fastening bar located at the top of itself. The fastening bar includes a long incline and a short incline respectively located at its near and distal pluggable ends. The locking plate includes a longitudinal resilient fastener and two transverse resilient fasteners respectively located in the middle and at the two sides of the locking plate.

In a further optimized technical solution, upon the plate end connector and cable end connector to be plugged together, the fastening plate and the fastening bar are getting closer to one another, and the sliding slope abuts the long incline; the fastening plate is deformed and lifted under pressure of opposite movement, and with the continuation of the opposite movement, the hook at the pluggable end of the fastening plate is displaced to the side of short incline of the fastening bar and fastened.

After the plate end connector and cable end connector are plugged together, there is a cavity under the fastening plate and the fastening bar into which the locking plate can be inserted; when the locking plate is inserted into the cavity, the near pluggable end of the longitudinal resilient fastener firstly abuts the sliding slope, and the longitudinal resilient fastener is downwardly deformed under pressure of opposite movement, and with the continuation of the opposite movement, the longitudinal resilient fastener at the near pluggable end is displaced to the side of long incline of the fastening bar and fastened.

In a further optimized technical solution, the locking plate can be inserted into the cavity, and the transverse resilient fastener of the locking plate can be fastened inside of the cavity.

Compared with the prior art, the beneficial effect of the improved structure of lead bonding for DC contactor is double locking. Specifically, the first locking is the locking between the fastening plate and the fastening bar after the plate end and the cable end connectors are plugged; the second locking is the formed after the plate end and cable end connectors are plugged together by inserting the locking plate into the cavity under the fastening plate and fastening bar. The double locking mechanism is constructively simple and easier to operate and rather durable.

DETAILED DESCRIPTION

The present application will be detailed in connection with FIGS. 1 to 2 and the specific embodiments as well, which are in no way intended to limit the present application.

Embodiment 1

Figure 1:
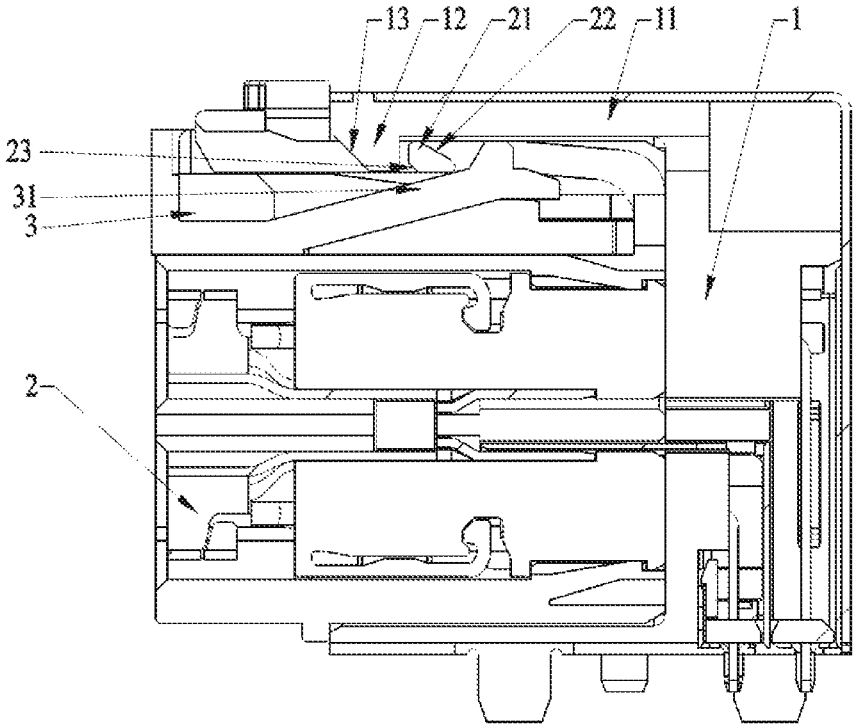
FIG. 1 is a schematic view of the double locking mechanism between plate end and cable end of an Ethernet vehicle connector
Figure 2:
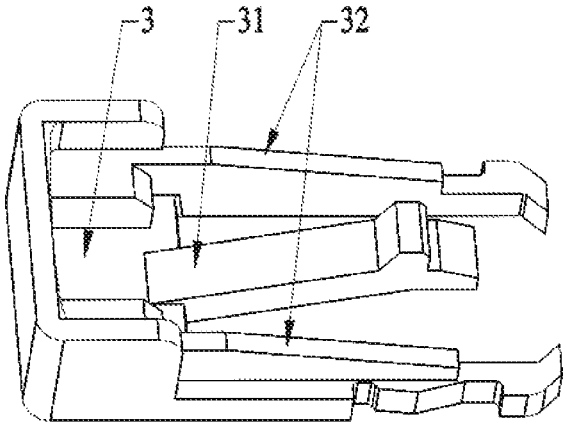
FIG. 2 is a schematic view of the locking plate.

As shown in FIGS. 1 and 2, a double locking mechanism between plate end and cable end of an Ethernet vehicle connector comprises a plate end connector body 1, a cable end connector body 2 and a locking plate 3, in which the connector bodies 1 and 2 are pluggable with each other.

The plate end connector body 1 includes a fastening plate 11 located at its top end. At the near pluggable end, the fastening plate 11 is provided with an inward hook 12, which is provided with a sliding slope 13 at the near pluggable end.

The cable end connector body 2 includes a fastening bar 21 located at the top of itself. The fastening bar 21 includes a long incline 22 and a short incline 23 respectively located at its near and distal pluggable ends.

The locking plate 3 includes a longitudinal resilient fastener 31 and two transverse resilient fasteners 32 respectively located in the middle and at the two sides of the locking plate 3.

Embodiment 2

On the basis of embodiment 1, as shown in FIGS. 1 and 2, a double locking mechanism between plate end and cable end of the Ethernet vehicle connector can get into a first locking state. That is to say, upon the plate end connector 1 and cable end connector 2 to be plugged together, the fastening plate 11 and the fastening bar 21 are getting closer to one another, and the sliding slope 13 abuts the long incline 22; the fastening plate 11 is deformed and lifted under pressure of opposite movement, and with the continuation of the opposite movement, the hook 12 at the pluggable end of the fastening plate 11 is displaced to the side of short incline 23 of the fastening bar 21 and fastened. The double locking mechanism can also get into a second locking state. That is to say, upon the plate end connector 1 and cable end connector 2 to be plugged together, there is a cavity under the fastening plate 11 and the fastening bar 21 into which the locking plate 3 can be inserted; when the locking plate 3 is inserted into the cavity, the near pluggable end of the longitudinal resilient fastener 31 firstly abuts the sliding slope 13, and the longitudinal resilient fastener 31 is downwardly deformed under pressure of opposite movement, and with the continuation of the opposite movement, the longitudinal resilient fastener 31 at the near pluggable end is displaced to the side of long incline 22 of the fastening bar 21 and fastened. Accordingly, the locking plate 3 can be inserted into the cavity, and the transverse resilient fastener 32 of the locking plate 3 can be fastened inside of the cavity.

In light of general technical knowledge, present technical solutions can be achieved by other embodiments which are not departed from spiritual substance or essential features of the application. Therefore, above described embodiments are simply illustrative in any way and are not intended to limit the application. All the changes within the range of the application or its equivalent are included in the application itself.

The invention claimed is:

1. A double locking mechanism between plate end and cable end of Ethernet vehicle connector, comprising a plate end connector body, a cable end connector body and a locking plate, wherein the plate end connector body and the cable end connector body are pluggable with each other;

characterized in that the plate end connector body includes a fastening plate located at its top end, and at the near pluggable end, the fastening plate is provided with an inward hook, which is provided with a sliding slope at the near pluggable end;

the cable end connector body includes a fastening bar located at the top of itself, and the fastening bar includes a long incline and a short incline respectively located at the near and distal pluggable ends of the fastening bar;

the locking plate includes a longitudinal resilient fastener and two transverse resilient fasteners respectively located in the middle and at the two sides of the locking plate;

characterized in that upon the plate end and cable end connectors to be plugged together, the fastening plate and the fastening bar are getting closer to one another, and the sliding slope abuts the long incline; the fastening plate is deformed and lifted under pressure of opposite movement, and with the continuation of the opposite movement, the hook at the pluggable end of the fastening plate is displaced to the side of the short incline of the fastening bar and fastened;

after the plate end and cable end connectors are plugged together, there is a cavity under the fastening plate and the fastening bar into which the locking plate can be inserted;

when the locking plate is inserted into the cavity, the near pluggable end of the longitudinal resilient fastener abuts the sliding slope, and the longitudinal resilient fastener is downwardly deformed under pressure of opposite movement, and with the continuation of the opposite movement, the longitudinal resilient fastener at the near pluggable end is displaced to the side of the long incline of the fastening bar and fastened.

2. The double locking mechanism between plate end and cable end of Ethernet vehicle connector as set forth in claim 1, further comprising a cavity and characterized in that the locking plate can be inserted into the cavity, and the transverse resilient fastener of the locking plate can be fastened inside of the cavity.

* * * * *